United States Patent [19]

Johnsson et al.

[11] Patent Number: 4,936,192

[45] Date of Patent: Jun. 26, 1990

[54] APPARATUS OPERATING BY MEANS OF COMPRESSED AIR

[75] Inventors: Nils Johnsson, Axvall; Börje Eriksson, Hjo, both of Sweden

[73] Assignee: Josef Kihlberg, Sweden

[21] Appl. No.: 227,702

[22] Filed: Aug. 3, 1988

[30] Foreign Application Priority Data

Aug. 13, 1987 [SE] Sweden ..... 8703146

[51] Int. Cl.[5] ..... F01B 15/02

[52] U.S. Cl. ..... 91/217; 227/130

[58] Field of Search ..... 227/130; 91/417 A, 206, 91/217

[56] References Cited

U.S. PATENT DOCUMENTS

| | | | |
|---|---|---|---|
| 2,979,725 | 9/1957 | Wandel et al. | 91/217 |
| 3,060,894 | 10/1962 | Dean et al. | 91/217 |
| 3,396,636 | 8/1968 | Bade | 227/130 |
| 3,434,643 | 3/1969 | Wandel | 227/130 |
| 4,480,528 | 11/1984 | Shiroyama | 227/130 |

*Primary Examiner*—Edward K. Look
*Assistant Examiner*—John Ryznic

[57] ABSTRACT

Apparatus operating by means of compressed air, comprising a displaceable cylinder, open at both ends, in which there bears a displaceable piston designed for expulsion of fixing elements fed forward below the piston. The cylinder and the piston are displaceable, by the action of air, in a cylinder housing between an upper and a lower end position at which are arranged damping elements. The cylinder and the piston bear with their respective and faces at their respective end positions against a surface of the damping element. The apparatus comprises an inlet and an outlet for the air, the flow of which is controlled by means of a valve, and an upper chamber and a lower chamber. These chambers are in connection with the inside of the cylinder by means of at least one opening in the cylinder wall. Furthermore, the apparatus comprises at least one second opening in the cylinder wall which is in connection with the outlet via a return channel depending on the position of the cylinder.

4 Claims, 4 Drawing Sheets

APPARATUS OPERATING BY MEANS OF COMPRESSED AIR

TECHNICAL FIELD

The present invention relates to a method and an arrangement for an apparatus for operating by means of compressed air, comprising a piston which is displaceable in a displaceable cylinder open at both ends and is designed for expulsion of fixing elements fed forward below the piston.

BACKGROUND

An apparatus for operating by means of compressed air and arranged for expulsion of fixing elements fed forward out from a magazine is previously known, in which apparatus there is arranged, in a cylinder housing, a movable cylinder in which there is arranged, in turn, a piston which is displaceable between two end positions. The apparatus comprises, for controlling the air flow for displacement of the cylinder and the piston, a number of valve bodies for delivery as well as evacuation of compressed air to the cylinder housing.

TECHNICAL PROBLEM

In this respect the valves are a factor which increases the cost of manufacturing the said apparatus, since the valve houses require high precision in the manufacturing in order for the valve needles and other elements incorporated in the valve to operate satisfactorily. In addition, the valves are sensitive to dirt which can be sucked in with the inlet air and result in operating disturbances in the apparatus.

Another disadvantage with the previously known apparatuses is that the compressed air acted upon by means of the valve is not conveyed directly for affecting and displacing the piston arranged in the cylinder, but the compressed air is passed through the often relatively small flow areas of the valve, which in turn involves a slow cylinder-filling and thus a lower speed of the piston. In order to obtain a high speed in the piston, a high pressure for the air is required under these circumstances in order to accelerate the piston, which usually involves a recoil effect on the apparatus during the piston movement.

THE SOLUTION

An apparatus for operating by means of compressed air is obtained by means of the invention, which eliminates the disadvantages of the previously known solutions. The apparatus comprises a displaceable cylinder in which a displaceable piston is arranged for expulsion of fixing elements, a first sealing element which bears against a section of an annular end face at one open end of the cylinder when the cylinder is in its upper position, a second sealing element which is arranged at a distance from the first element. The cylinder is set in motion by means of compressed air flowing through an upper chamber at the upper open end of the cylinder, in which connection compressed air flows into a second chamber located under the second sealing element and displaces the piston arranged in the cylinder to a lower end position during squeezing-out of air lying under the piston. By means of adjusting a valve, the air flow to the upper chamber is shut and air is allowed to flow in under the piston, in which connection the cylinder is displaced to the upper end position while air in the cylinder above the piston is allowed to flow out. In this way a higher air pressure is created under the piston than above the piston, in which connection the piston is displaced to the upper end position.

BRIEF DESCRIPTION OF DRAWINGS

The invention will be described in greater detail below on the basis of an exemplary embodiment with reference to the attached drawings in which.

PREFERRED EMBODIMENT

Figure 1:
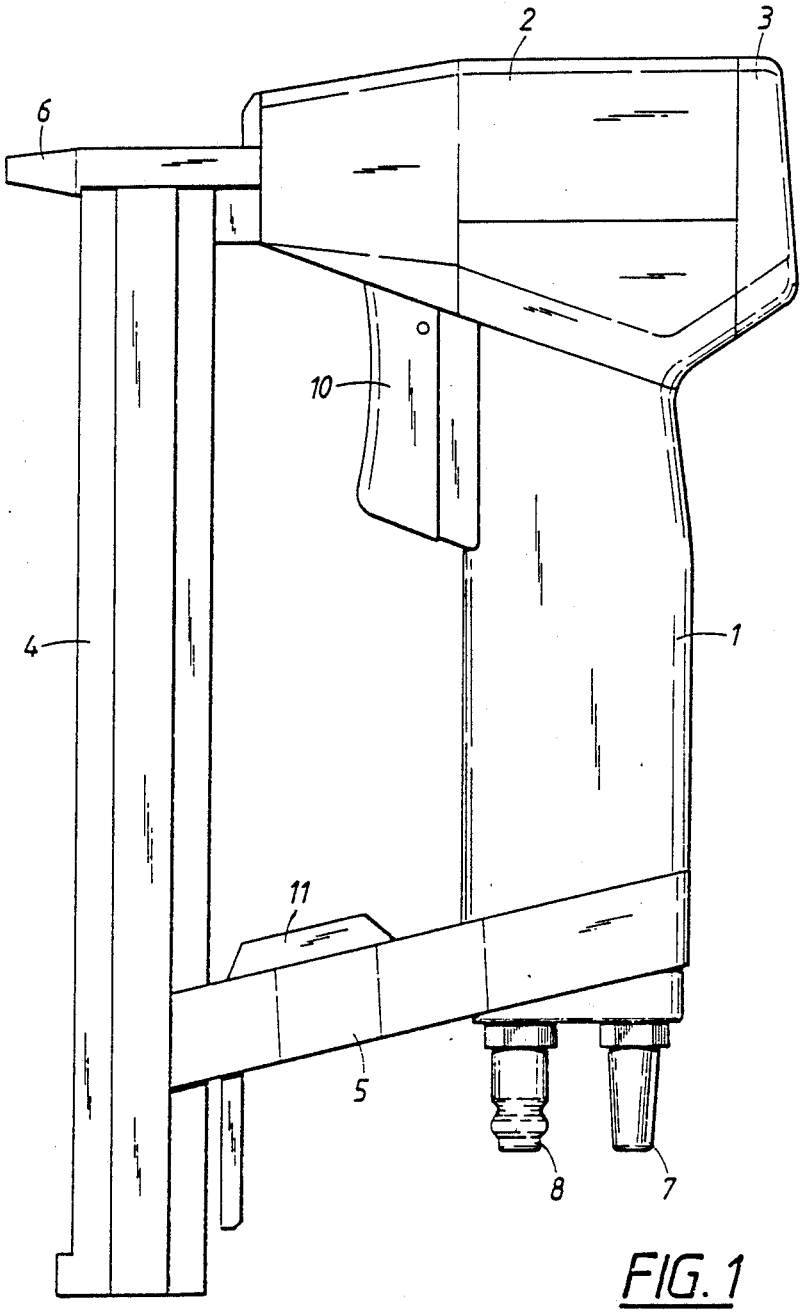
FIG. 1 shows a side view of the apparatus.

The invention will be described below on the basis of an exemplary embodiment with a compressed airdriven stapler, but it can of course be applied to any compressed air-driven apparatus for expulsion of fixing elements. As shown in FIG. 1 the apparatus comprises a handle part 1, a cylinder housing 2 arranged at one end of the handle part, and a cylinder head 3 arranged over the cylinder housing and a part of the handle part. A magazine 4 for fixing elements extends essentially parallel to the handle part 1 at a distance from the same and is connected to the handle part via a bar 5 and to the cylinder housing via a nozzle 6, which extends essentially transverse to the longitudinal direction of the magazine. Arranged at the rear end section of the handle part are a sound-absorbing element 7, hereinafter referred to as sound damper 7, for outlet air and a nipple 8 for inlet air. A trigger 10 is arranged under the handle part 1 on the cylinder housing 2. Arranged on the bar 5 is an opener 11 designed for opening the magazine 4.

Figure 2:
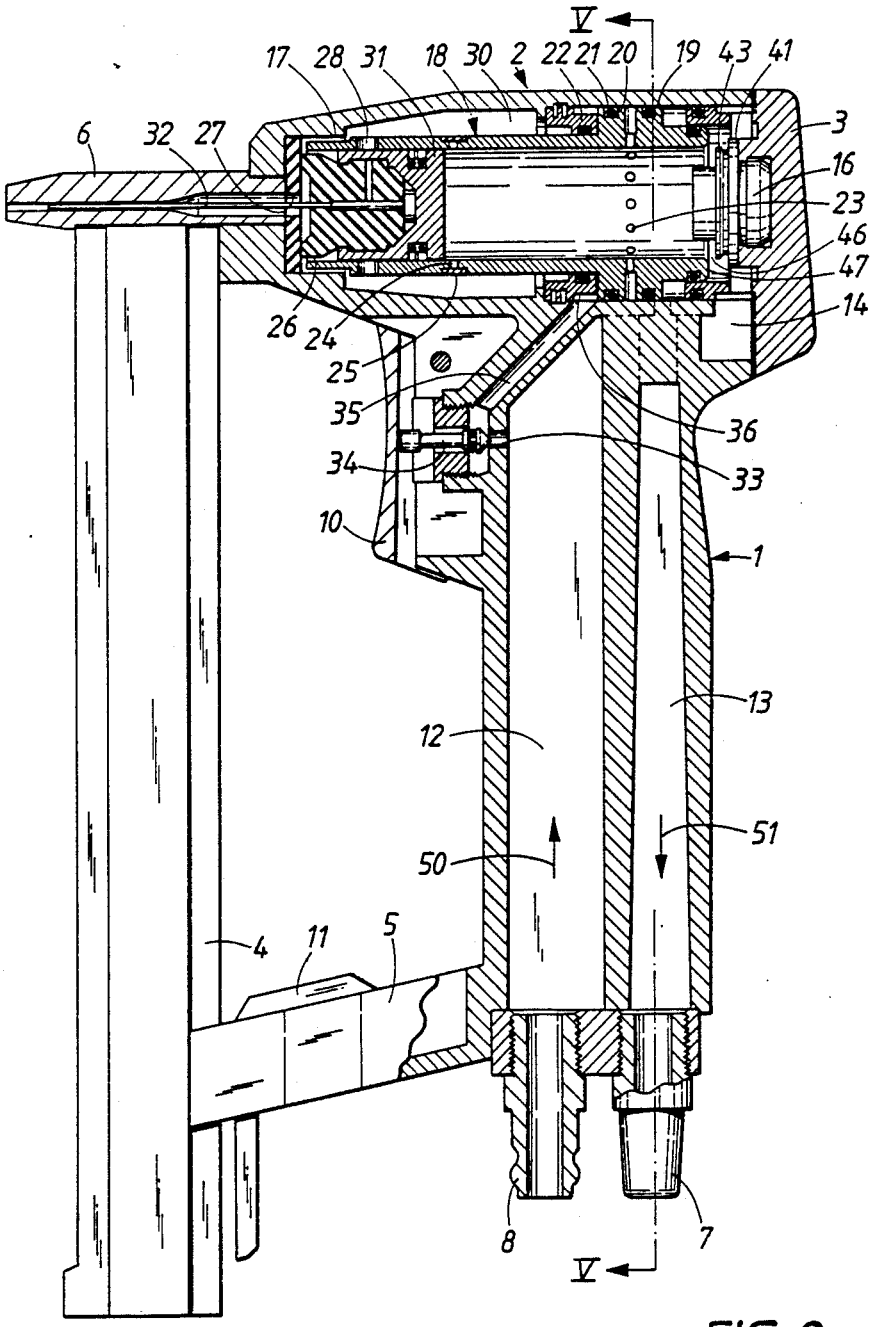
FIG. 2 shows a section along the line II—II in FIG. 5.

As shown in FIG. 2 the handle part comprises a slightly conical inlet channel 12 and a slightly conical outlet channel 13, which channels have their greatest diameter at the transition from the channel to the sound damper 7 or nipple 8 of the respective channel. The inlet channel 12 tapers towards the cylinder housing 2 and curves off against the cylinder housing and runs parallel to the latter round the outlet channel 13 up to an upper chamber 14. The upper chamber is in connection via an opening in its wall with an annular cylinder head chamber 15 which extends round an upper damping element 16 arranged in the cylinder head 3, which element is hereinafter called upper damper 16 and will be described in detail hereinafter.

The cylinder housing 2 comprises an essentially cylindrical inner space 39 which is essentially transverse to the longitudinal directions of the inlet and outlet channels 12, 13 respectively, and which inner space tapers towards its lower end section as shown in FIG. 2 and is, at the said end section, provided with a cylinder part 17 whose diameter is clearly less than the greatest inside diameter of the cylinder housing. Arranged in the inner space 39 of the cylinder housing is a displaceable cylinder 18 open at both ends, the length of which is less than the length of the inner space of the cylinder housing. An end section of the cylinder 18 is arranged in the cylinder part 17, the diameter 18 of the cylinder being slightly less than the diameter of the cylinder part, in which connection there is formed around the cylinder, between its outer circumferential surface and the inner circumferential surface of the cylinder part, a bearing and guide for the cylinder. At the opposite end section of the cylinder a distance from its open end, two cylinder flanges 19, 20 extend around the outer circumferential surface of the cylinder, the outer diameter of the cylinder flanges being slightly less than the diameter of the inner space 39 of the cylinder housing. The cylinder flanges are provided with an annular groove in which is arranged a sealing element 21 which is preferably made of an elastomeric material and can be composed of an O-ring. Arranged under the cylinder flange 20 round the cylinder with support against the inner circumferential surface of the cylinder housing is a spacer ring 22 having a groove turned towards the outer circumferential surface of the cylinder, in which groove is arranged a second sealing element, preferably in the form of an elastomeric material such as an O-ring. The said sealing element creates an airtight seal against the outer circumferential surface of the cylinder.

The cylinder 18 is provided with a number of openings 23, hereinafter called return openings 23, arranged in the cylinder wall between the first cylinder flange 19 and the second cylinder flange 20. The cylinder moreover has at least one, preferably several other openings 24 which lead into an annular groove which runs round the outer circumferential surface of the cylinder, in which groove a cover element 25 is arranged and preferably endlessly and made of an elastomeric material and can be in the form of an elastomeric band arranged in the groove, in which connection the said openings 24 together with the covering element have the function of a nonreturn valve.

Arranged in the cylinder part 17 is a lower damper 26 whose diameter is only slightly less than the inner diameter of the cylinder part, and which damper is provided with a centrally placed opening 27. The damper is preferably made of a shock-absorbing material such as polyerythane(sic) rubber or a similar rubber mixture.

Under the nonreturn valve in the cylinder wall there is arranged a third opening 28, or preferably several, which forms a connection between the inner space of the cylinder and a return chamber 30 extending round the cylinder. A displaceable piston 31 of cylindrical cross section area is arranged in the cylinder, in which connection the diameter of the piston is slightly less than the inner diameter of the cylinder. The piston has an annular groove in which a seal is arranged and which forms an airtight or almost airtight seal against the inner circumferential surface of the cylinder 18. Extending out from the piston, in the imagined direction of movement of the piston, is a driver element 32 preferably in the form of an elongate flat element whose cross section area is clearly smaller than the opening 27. The driver element 32 extends a distance into a channel which extends through the nozzle 6.

Arranged in the wall of the inlet channel 12 over the trigger 10 is a valve opening 33 which forms a connecting path for the air past a valve 34, preferably a needle valve into a second inlet channel 35 oblique relative to the longitudinal direction of the inlet channel, which second inlet channel 35 empties into an intermediate chamber 36 which in turn runs round the cylinder 18 between the upper end face of the spacer ring 22 and the lower face of the second cylinder flange 20 and whose capacity depends on the position of the cylinder in the space 39 of the cylinder housing.

Figure 3:
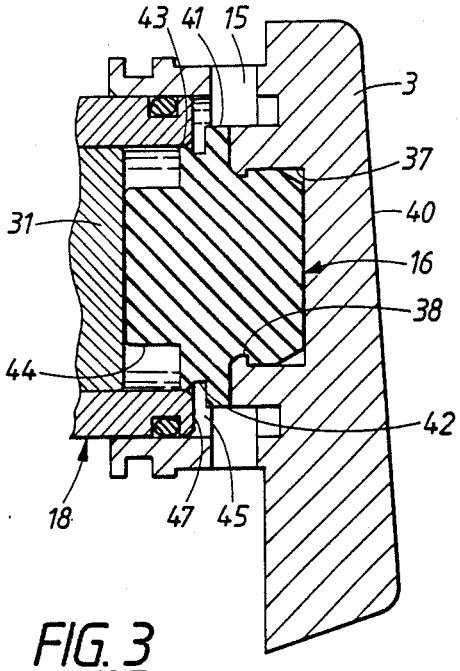
FIG. 3 shows a partially broken section along the same section line as in FIG. 2, but with a cylinder and piston arranged on the apparatus in another working position than as shown in FIG. 2.
Figure 4:
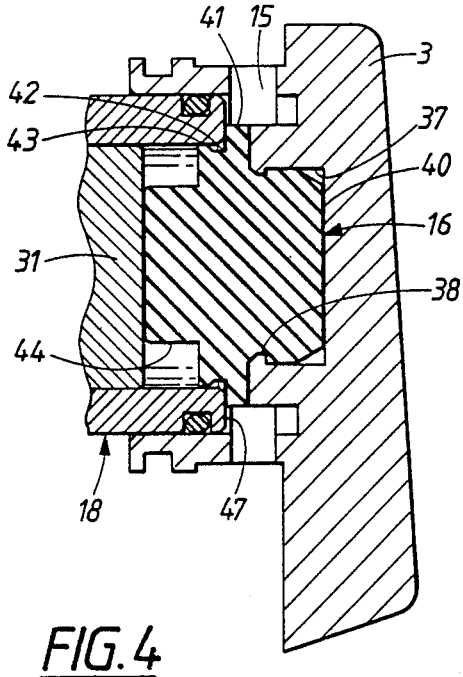
FIG. 4 shows a partially broken section along the same section line as in FIG. 2, but with the cylinder and piston in an upper end position.
Figure 5:
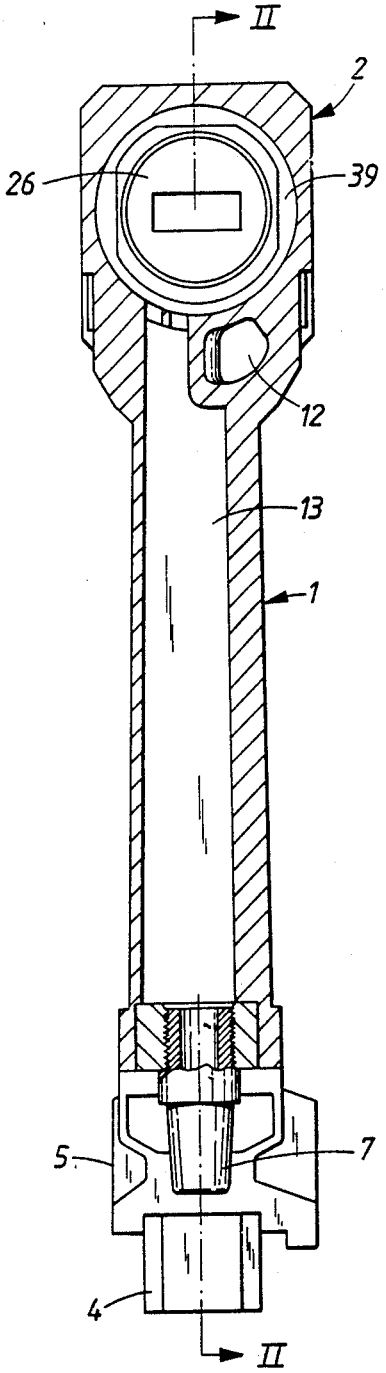
FIG. 5 shows a section along the line V—V in FIG. 2.

As shown in FIGS. 1 and 2 the cylinder head 3 is arranged in a tight-fitting position over the cylinder 18 and the cylinder housing 2, and which cylinder head has, arranged on its inner side in a position directly above the upper open end of the cylinder 18, a recess 37 provided with an annular knob section 38 directed towards the open end of the cylinder. As shown in FIGS. 3 and 4 the upper damper 16 is arranged in the said recess with an attachment part. Extending round the cylindrical damper 16 over the annular end section of the recess is a first flange 41 which, with its tangential end face, forms together with the cylinder head 3 an inner wall of the cylinder head chamber 15, in which connection the diameter of the first flange 41 is greater than the inner diameter of the cylinder 18, but is less than the outer diameter of the cylinder and is adapted to bear against an annular end face 47 of the cylinder. Arranged under the first flange is a preferably cylindrical spacer element 42, whose diameter is clearly less than the diameter of the first flange, and which spacer element forms a connection element between the first flange 41 and a second cylindrical flange 43, whose diameter is greater than the diameter of the spacer element, but is less than the diameter of the first flange, in which connection the diameter of the second flange 43 coincides with or is slightly less than the inner diameter of the cylinder 18, so that an annular groove is formed between the first flange 41 and the second flange 43. Arranged under the second flange is a buffer part 44 whose diameter is clearly less than the inner diameter of the cylinder 18 and constitutes a damping and spacer element for the piston 31 in an upper position so that the piston, via a section of its upper thrust face, bears against the buffer part 44 at a distance from the second flange 43.

The cylinder head bears with an annular projecting section in the inner space 39 of the cylinder housing 2, in which connection there is formed an upper annular chamber 45 between the said annular part and the upper damper 16, which chamber 45 in turn forms a flow channel 46 from the cylinder head chamber 15 past the upper damper into the cylinder 18, as emerges most clearly from FIG. 2.

The present apparatus is connected, at the nipple 8, by means of a preferably flexible tubing to a compressed air network, in which connection air flows in, in the direction of the arrow 50, up into the upper chamber 14 and through the valve opening 33 past the valve 34, through the second inlet channel 35 up into the intermediate chamber 36, in which connection the cylinder 18 is retained in its upper position. As shown in FIG. 4 an upper annular end section of the cylinder 18 bears and thus seals against the first flange 41, in which connection the second flange 43 forms a lip seal against the inner circumferential surface of the cylinder. In this connection the flow channel 46 from the cylinder head chamber 15 into the cylinder 18 is closed.

When the trigger 10 is squeezed, the valve 34 closes the valve opening 33 at the same time as a return opening is formed past the valve, in which connection the second inlet channel 35 and the intermediate chamber 36 are evacuated of air which can flow past the valve out at the trigger 10. In this way the pressure acting to maintain the cylinder against the second cylinder flange 20 is reduced, in which connection the pressure against the upper annular end face 47 of the cylinder exceeds the pressure against the second cylinder flange 20, and the cylinder 18 is displaced towards its other end position in the inner space 39 of the cylinder housing, in which connection air is allowed to flow past the first flange 41 and the annular end face 47 of the cylinder in the annular groove between the first and second flange 41, 43 of the upper damper 16, as shown in FIG. 3. In this way an overpressure is built up in the annular groove formed in the spacer element 42, and the compressed air thus acts on the entire annular end face 47 of the cylinder, this resulting in an extremely quick displacement of the cylinder 18 towards the lower damper 26. When the cylinder 18 is displaced relative to the upper damper 16 and the second flange 43 ceases to bear against the inner circumferential surface of the cylinder 18, the air enclosed in the annular groove and the cylinder head chamber 15 flows out with great force in the flow channel 46 and hits the upper pressure surface of the piston 31, in which connection the piston is displaced in the cylinder at great speed towards the lower damper 26. Immediately before the flange 43 ceases to bear against the inner circumferential surface of the cylinder 18, the cylinder flange 19 has passed the outlet channel 13 and thus air is prevented from flowing directly out through the openings 23 in the cylinder wall out into the outlet channel 13.

The outer annular end face of the piston 31 comes to bear against the lower damper 26 in its second end position, as shown in FIG. 2. During the downward movement of the piston the air, which is located under the piston in the cylinder and which is at atmospheric pressure, is squeezed out both through the third opening 28 into the return chamber 30 and out through the opening 27. When the piston 31 is in its lower position, as shown in FIG. 2, and the trigger 10 is held squeezed in, an overpressure is maintained in the cylinder 18 by means of air which flows from the inlet channel 12 into the cylinder and which exerts a pressure on the upper thrust face of the piston. In this way a pressure compensation of air is brought about between the cylinder 18 and the return chamber 30, in which connection air flows out through the openings 24 and past the covering elastomeric element 25 whose bearing pressure against the openings is no greater than required for the said pressure compensation to be easily effected.

During the downward movement of the piston, the driver element 32 is displaced through the opening 27 in the lower damper 26 through the channel in the nozzle 6 and hits with great force, and drives out from the nozzle, a fixing element fed from the magazine 4, such as a staple.

When the trigger is released, the valve opening 33 is uncovered and air is allowed to flow into the valve opening 33 past the valve 34, through the second inlet channel 35 up into the intermediate chamber 36, in which connection an overpressure is built up in the intermediate chamber, and which air pressure exerts a pressure on the second cylinder flange 20, which displaces the cylinder 18 upwards to bear with its annular end face 47 against the first flange 41 of the upper damper 16. In this way the flow channel 46 is closed at the same time as the return openings come in front of the outlet channel 13, in which connection the pressure in the cylinder quickly falls. Since the outlet channel 13 is conical, with its greatest opening at the sound damper 7, the evacuation of the air in the direction of the arrow 51 is facilitated and accelerated. The nonreturn valve 24, 25 prevents the air from flowing back into the cylinder above the piston. In this way a pressure difference is created between the air in the return chamber 30 and the cylinder 18, in which connection air flows through the openings 28 and the air gap at the outer circumferential surface of the cylinder and the cylinder part 17, in which connection the pressure in the cylinder above the piston 31 is less than the pressure below the latter, in such a way that the air pressure below the piston, between the piston and the lower damper 26, displaces the piston in the cylinder 18 to bear against the buffer part 44 of the upper damper 16, in which connection, during the movement of the piston, the air compressed in the cylinder is continuously evacuated through the return openings 23 out into the outlet channel 13. The piston is maintained in its upper end position by the friction between the annular seals of the piston and the inner circumferential surface of the cylinder. During the return movement of the piston to its first upper end position, a fixing element is fed from the magazine in a manner known per se out into the channel in the nozzle.

The illustrated apparatus according to the invention is, as emerges from what has been stated above, extremely simple in its construction and design. By virtue of the fact that the apparatus only comprises one valve, labor costs are reduced and operational reliability increased. In addition, the special design of the upper damper constitutes a delay in the displacement of the piston relative to the displacement of the cylinder, in which connection an overpressure has time to build up and the opening to the outlet channel 13 has time to close before the pressure is turned on the upper pressure surface of the piston. In this way the acceleration of the piston is increased without higher air pressure being required, and at the same time the weight of the piston can be reduced. By means of the present invention, the compressed air necessary for the displacement of the piston and cylinder can be prevented from being conveyed past the valve, and instead is allowed to act directly on the piston. It will emerge from the above that the present apparatus is extremely simple and inexpensive to produce and is easy to assemble.

The invention is not limited to the exemplary embodiment mentioned above and shown in the drawings, but can be varied within the scope of the following patent claims.

I claim:

1. Apparatus for operating by means of compressed air comprising: a housing, a displaceable cylinder open at both ends in said housing, a piston displaceable in said cylinder, means for displacing said cylinder and said piston by the action of air between an upper and a lower end position in said housing, damping elements for said cylinder and piston located at said upper and lower end positions, an inlet channel and an outlet channel for air, a valve for controlling the flow of air to said inlet channel, a first upper air chamber, a lower chamber, which is in connection with the inside of said cylinder by means of at least one opening in a wall of said cylinder, at least one second opening in the cylinder wall which is in connection with said outlet channel depending on the position of said cylinder, a first sealing element, which is positioned to bear against a section of an annular end face at one open end of said cylinder when said cylinder is in its upper end position, a second sealing element, which is located at a distance from said first sealing element and which is positioned to bear against an inner circumferential surface of said cylinder when said cylinder is in said upper end position, a second air chamber located under said first air chamber and in connection with said inlet channel, whereby said valve is operable for controlling the pressure in said first and second air chambers to set said cylinder in motion, and means being provided to set said piston in motion after said cylinder has been moved a certain distance.

2. Apparatus according to claim 1, wherein the damping element at said upper end position comprises said first and second sealing elements and comprises respectively a first flange having a diameter which exceeds the inner diameter of said cylinder and a second flange having a diameter which is slightly less than the inner diameter of said cylinder, and a groove between said first and second flanges, said second air chamber being delimited by the outer circumferential surface of said cylinder and the inner circumferential surface of said housing, and said first upper air chamber being continuously supplied with air, whereby when said valve is operated to evacuate air pressure in said inlet channel in connection with said second air chamber, the air pressure in said first upper air chamber is exerted against the annular end face of said cylinder which projects beyond said first flange so that said cylinder is displaced towards said lower end position thereof and creates a flow opening between said first flange and said annular end face of said cylinder to an annular air channel comprised of said groove, a flow channel being formed in said cylinder when said cylinder is displaced past said second flange.

3. Apparatus according to claim 2, wherein said piston bears against said damping element at said upper end position at a distance from said second flange.

4. Apparatus according to anyone of claims 1 to 3, wherein said damping element at said upper end position is cylindrical and is located in an end section of said housing, a section of said upper damping element projecting into said cylinder to a varying degree depending on the position of said cylinder.

* * * * *